US010586521B2

(12) United States Patent
Thornock et al.

(10) Patent No.: US 10,586,521 B2
(45) Date of Patent: Mar. 10, 2020

(54) EAR INTERFACE DETECTION

(71) Applicant: Cirrus Logic International Semiconductor Ltd., Edinburgh (GB)

(72) Inventors: Brian Thornock, Pflugerville, TX (US); Antonio J. Miller, Sammamish, WA (US)

(73) Assignee: Cirrus Logic, Inc., Austin ( * ) Notice: Subject to any disclaimer, the term of this patent is extended or adjusted under 35 U.S.C. 154(b) by 137 days.

(21) Appl. No.: 15/339,544

(22) Filed: Oct. 31, 2016

(65) Prior Publication Data

US 2018/0122357 A1 May 3, 2018

(51) Int. Cl.

| | |
|---|---|
| ***G10K 11/178*** | (2006.01) |
| ***H04R 1/10*** | (2006.01) |
| ***H04R 3/00*** | (2006.01) |

(52) U.S. Cl.

CPC ..... *G10K 11/178* (2013.01); *G10K 11/1783* (2018.01); *G10K 11/17817* (2018.01); *G10K 11/17881* (2018.01); *H04R 1/1083* (2013.01); *H04R 3/005* (2013.01); *G10K 2210/1081* (2013.01); *G10K 2210/3035* (2013.01); *G10K 2210/3036* (2013.01); *G10K 2210/3045* (2013.01); *G10K 2210/30351* (2013.01); *H04R 2410/05* (2013.01); *H04R 2499/11* (2013.01)

(58) Field of Classification Search

CPC ..... G10K 11/1788; G10K 2210/1081; G10K 2210/3035; G10K 2210/3027; H04R 2460/01; H04R 2410/05; H04R 25/505

See application file for complete search history.

(56) References Cited

U.S. PATENT DOCUMENTS

| | | | | |
|---|---|---|---|---|
| 2008/0181422 | A1* | 7/2008 | Christoph | G10K 11/1784 381/73.1 |
| 2009/0034748 | A1* | 2/2009 | Sibbald | G10K 11/178 381/71.6 |
| 2010/0189268 | A1 | 7/2010 | Haartsen et al. | |
| 2010/0272282 | A1 | 10/2010 | Carreras | |
| 2011/0116643 | A1* | 5/2011 | Tiscareno | H04R 1/1016 381/58 |

(Continued)

FOREIGN PATENT DOCUMENTS

GB 2441835 A 3/2008

OTHER PUBLICATIONS

Guldenshuh, Secondary path Models in Adaptive Noise Control headphones (Year: 2013).*

*Primary Examiner* — Davetta W Goins
*Assistant Examiner* — Kuassi A Ganmavo
(74) *Attorney, Agent, or Firm* — Norton Rose Fulbright US LLP

(57) ABSTRACT

An ear interface mode of headphones may be determined by measuring an acoustic response of the headphones. For example, the headphones may be determined to be in a leaky or sealed configuration. An adaptive noise cancellation (ANC) system may be controlled based on the determined ear interface mode of the headphones. For example, a set of configuration parameters may be loaded for the ANC system corresponding to the known ear interface mode. An anti-noise signal may be generated according to the selected configuration parameters, and that anti-noise signal added during playback of media, such as voice recordings, music, videos, or telephone call speech.

17 Claims, 9 Drawing Sheets

(56) References Cited

U.S. PATENT DOCUMENTS

2012/0140943 A1 6/2012 Hendrix et al.
2012/0321103 A1* 12/2012 Smailagic ..... H04R 1/1041 381/98
2013/0170656 A1* 7/2013 Tiscareno ..... H04R 1/1016 381/57
2013/0190058 A1* 7/2013 Lee ..... H04R 1/10 455/569.1
2013/0287219 A1 10/2013 Hendrix et al.
2013/0301849 A1 11/2013 Alderson et al.
2014/0146976 A1* 5/2014 Rundle ..... H04R 1/1083 381/71.6
2014/0341388 A1* 11/2014 Goldstein ..... H04R 1/1083 381/71.11
2015/0071453 A1* 3/2015 Po ..... G10K 11/175 381/71.11
2015/0092953 A1* 4/2015 Abdollahzadeh Milani ..... G10K 11/1784 381/71.6
2015/0195646 A1* 7/2015 Kumar ..... G10K 11/178 381/71.8
2015/0243271 A1* 8/2015 Goldstein ..... G10L 21/0208 381/71.6
2015/0310846 A1* 10/2015 Andersen ..... B05B 7/0884 381/71.6
2016/0300562 A1 10/2016 Goldstein
2016/0309270 A1 10/2016 Miller et al.
2017/0026732 A1* 1/2017 Kirsch ..... H04R 1/1041

* cited by examiner

EAR INTERFACE DETECTION

FIELD OF THE DISCLOSURE

The instant disclosure relates to electronic devices. More specifically, portions of this disclosure relate to audio playback by electronic devices, such as mobile phones, mobile entertainment devices, media players, set-top boxes, and other electronic devices.

BACKGROUND

Mobile devices are carried by a user throughout most or all of a day. During the day, the user may encounter many different environments, each with a different background noise characteristic and other acoustic effects. Mobile devices employ noise cancelling to take into account the environmental changes and improve the user's experience while using the mobile device. Environmental changes may change due to a number of factors within or outside of the user's control. Although some noise cancelling techniques exist, further improvements in noise cancelling can further improve the audio quality and user experience when receive audio output from an electronic device.

Shortcomings mentioned here are only representative and are included simply to highlight that a need exists for improved electrical components, particularly for audio components employed in consumer-level devices, such as mobile phones. Embodiments described herein address certain shortcomings but not necessarily each and every one described here or known in the art.

SUMMARY

One environmental factor that can change the way a user perceives audio from a transducer, such as a headphone, is the configuration of the headphone. For example, some headphone earbuds are configurable, such as through configurable tips, configurable seals, and configurable attachment devices, among other options. Regarding configurable seals, a headphone earbud may allow a user to use the earbud with or without an overmold. These overmolds are frequently made of silicone and allow for a degree of individualization for each listener through ear tip size, number of flanges, and/or durometer. With the overmold installed on the earbud, the earbud may form a tighter seal in the user's ear canal. Without the overmold installed on the earbud, the earbud may form little or no seal in the user's ear canal.

These two tip configurations, referred to as ear interface modes, can significantly change the environmental factors around the earbud that influence a user's perception of audio produced by the earbud. Ear interface modes define how a transducer of a headphone device interfaces with a user's ear when reproducing audio sounds. Ear interface modes differ from on-ear and off-ear detection, which do not address, for example, a seal quality of the user's ear with a transducer. Instead on-ear and off-ear detection does not represent, for example, a quality or presence of fitting with the user's ear but instead is focused on a distance between the transducer and the user's head. Ear interface modes also differ from seal quality assessments because seal quality is not able to determine, for example, a presence or configuration of ear tips but instead is focused on an amount of external sounds entering the user's ear canal.

Differences between the ear interfaces mode can be mathematically expressed through a transfer function, and that transfer function used to adapt an audio signal being output to the earbud to compensate for differences between the earbud seal configurations. More generically, different ear interface modes may be compensated for by adapting the audio output, such as to improve a user's experience while listening to the audio or to normalize audio output between different ear interface modes. The compensation may be applied through adjusting parameters for an adaptive noise cancellation (ANC) system that is performing part of the function of generating the audio output.

A method for detecting and adapting to the configuration of a headphone device in an electronic device having an ANC system may allow for improved performance and user experience regardless of the configuration of the headphones. This method may also extend to a set of possible configurations that would allow for improved performance for as wide a set of listeners as possible. For example, the electronic device may be configured to detect whether a headset is used with no ear tips, or with large or small ear tips and automatically adjust the tuning parameters to enable the ANC system for improved performance for all configurations by changing parameters to match the configuration, rather than implement a single set of parameters that achieve compromised performance in all configurations. The presence of ear tips may refer to molded silicone. The ear tips may come in different sizes (e.g., small, medium, large), different states (e.g., on earbud or off earbud), number of flanges, and durometer. Each of which may be a different ear interface mode resulting in different acoustic response, particularly in low frequencies.

The ear interface configuration may be determined by comparing the measured acoustic response, including secondary path estimation, to a look-up table. For example, a closest match in the look-up table may be matched to the determined acoustic response. In some embodiments, the look-up table may include acoustic responses for different headphone devices, acoustic responses for different ear tip configurations, and/or acoustic responses for different ear tip configurations of different headphone devices. The ear interface configuration may also or alternatively be determined by using a model of an ear canal response to perform optimal fit characterization, ear canal resonance modeling, multiband spectral analysis, analysis of magnitude of response in different frequency bands, and/or applying curve fitting or shape identification algorithm.

The operation of detecting the ear interface mode and adjusting ANC based on the ear interface mode may take place at any time. In some embodiments, the tip configuration may be performed by auto detection. In some embodiments, the ear tip configuration may be initiated or changed with a button press. In some embodiments, the ear tip configuration may be input through an application executing on the electronic device. In some embodiments, tolerances may be configured around matches between measured acoustic response including secondary path and look-up table values or modeled values for different ear interface modes. Adjustments to ANC parameters may be delayed until enough information is collected to make a determination within the configured tolerances for identifying an ear interface mode.

One application for such an adaptive noise cancellation system that adjusts based on an ear interface mode of the headphones is a mobile phone. Mobile phones may playback audio, such as audio stored locally, audio stored remotely over a network, and/or speech for a telephone call received from a network. Such a mobile device may include an audio playback path and an adaptive noise cancellation (ANC) system for adjusting the output of the audio playback path before sounds are reproduced from a transducer. The ANC system may include a microphone and determine a transfer function for a secondary path acoustic volume between the transducer and the microphone. Measurements of the secondary path acoustic volume, such as performed by outputting test signals through the transducer and monitoring the microphone, may be used to determine an ear interface mode of the headphones, such as to determine whether a tip is attached to the earbud.

In some embodiments, a method may include determining an acoustic response of a headphone device by estimating a secondary path of an adaptive noise cancellation (ANC) system including the headphone device. Then, a particular ear interface mode of two or more ear interface modes may be selected based on the determined acoustic response. Next, a set of configuration parameters for the ANC system may be selected based on the determined ear interface mode. The configured ANC system may be used to modify audio signals being output to a transducer, such as by generating an anti-noise signal according to the configuration parameters. The method may be implemented in an electronic device by a processor executing part or all of the described method. The processor may be, for example, an audio controller, a digital signal processor (DSP), a general central processing unit (CPU), or other logic circuitry configured through firmware and/or software to perform some or all of the described method.

The foregoing has outlined rather broadly certain features and technical advantages of embodiments of the present invention in order that the detailed description that follows may be better understood. Additional features and advantages will be described hereinafter that form the subject of the claims of the invention. It should be appreciated by those having ordinary skill in the art that the conception and specific embodiment disclosed may be readily utilized as a basis for modifying or designing other structures for carrying out the same or similar purposes. It should also be realized by those having ordinary skill in the art that such equivalent constructions do not depart from the spirit and scope of the invention as set forth in the appended claims. Additional features will be better understood from the following description when considered in connection with the accompanying figures. It is to be expressly understood, however, that each of the figures is provided for the purpose of illustration and description only and is not intended to limit the present invention.

BRIEF DESCRIPTION OF THE DRAWINGS

For a more complete understanding of the disclosed system and methods, reference is now made to the following descriptions taken in conjunction with the accompanying drawings.

DETAILED DESCRIPTION

Figure 1:
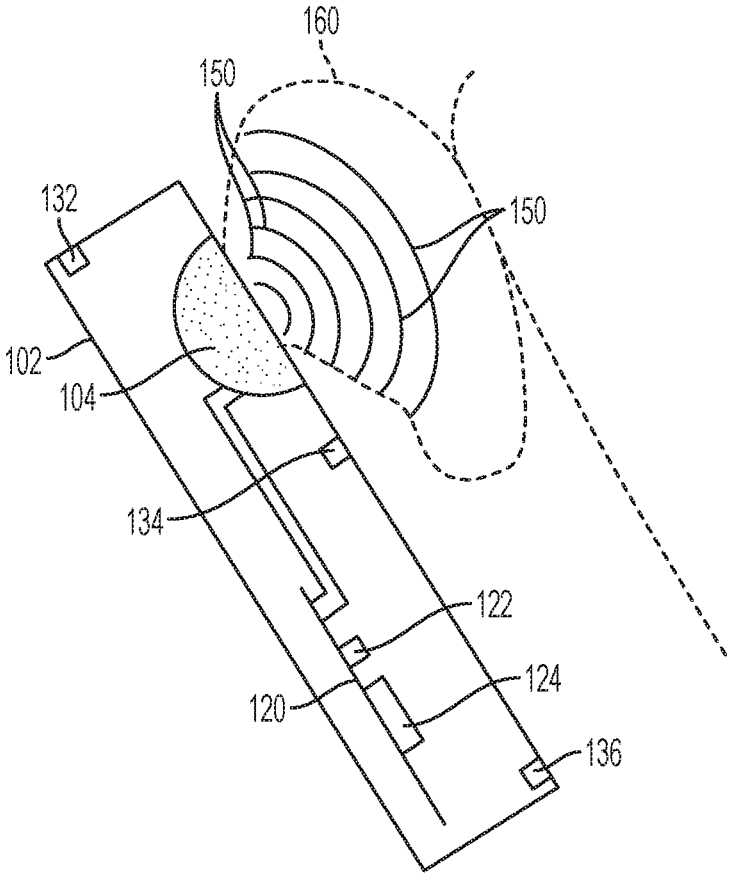
FIG. 1 is a cross-section illustrating a mobile device with speaker impedance monitoring according to one embodiment of the disclosure.

FIG. 1 is a cross-section illustrating a mobile device with speaker impedance monitoring according to one embodiment of the disclosure. A mobile device 102 may be placed near a user's ear 160. The mobile device 102 may be, for example, a mobile phone, a tablet computer, a laptop computer, or a wireless earpiece. The mobile device 102 may include a speaker 104, such as a transducer, driven by an amplifier 122 of a circuit 120. The speaker 104 may generate an acoustic sound field 150 near the mobile device 102. The user's ear 160 translates the acoustic sound field 150 into recognizable sounds for the user. For example, the acoustic sound field 150 may include speech conversations occurring during a phone call, playback of a voice mail message, playback of ring tones, and/or playback of audio or video files. The amplifier 122 may receive audio signals from a processor 124 of the circuit 120, such as a digital signal processor (DSP).

The mobile device 102 may also include a near-speech microphone 136, an error microphone 134, and a reference microphone 132, each of which may be an analog or digital microphone. Each of the microphones 132, 134, and 136 receive audible sounds fields and translate the acoustic sound fields into electrical signals for processing by the circuit 120. For example, the near-speech microphone 136 may receive speech during a conversation occurring during a phone call. In another example, the error microphone 134 may receive the acoustic sound field 150 generated by the speaker 104. In a further example, the reference microphone 132 may be positioned away from a typical position of a user's mouth and may measure an ambient acoustic environment.

In some embodiments, aspects of the ANC system described above may be implemented through headphone earbuds. For example, the speaker 104 may be located inside a headphone earbud that is configured to rest on a user's ear 160 or fit within an ear canal of the user's ear 160. Furthermore, any one or more of the microphones 132, 134, and 136 may be integrated with the headphone device, either into the earbud or as a microphone attached to a line leading to the earbuds. The circuit 120 may perform steps to determine a configuration of a headphone device containing the speaker 104 and implement configuration parameters in an ANC system based on the determined configuration. For example, the processor 124 may determine a transfer function for a secondary path of the ANC system between the speaker 104 and one of the microphones 132, 134, and 136. The determined transfer function may be identified as corresponding to headphones with no overmolds (e.g., ear tips), overmolds with a leaky seal, or overmolds with a tight seal. The processor 124 may set configuration parameters for the ANC system implemented by the circuit 120 based on the determined headphone ear interface mode. When the mobile device 102 plays audio through the headphones, the ANC system may generate an anti-noise signal for adjusting the audio output to the speaker 104. The anti-noise signal may be based on input from one or more of the microphones 132, 134, and 136 and also based on the set configuration parameters.

Figure 2:
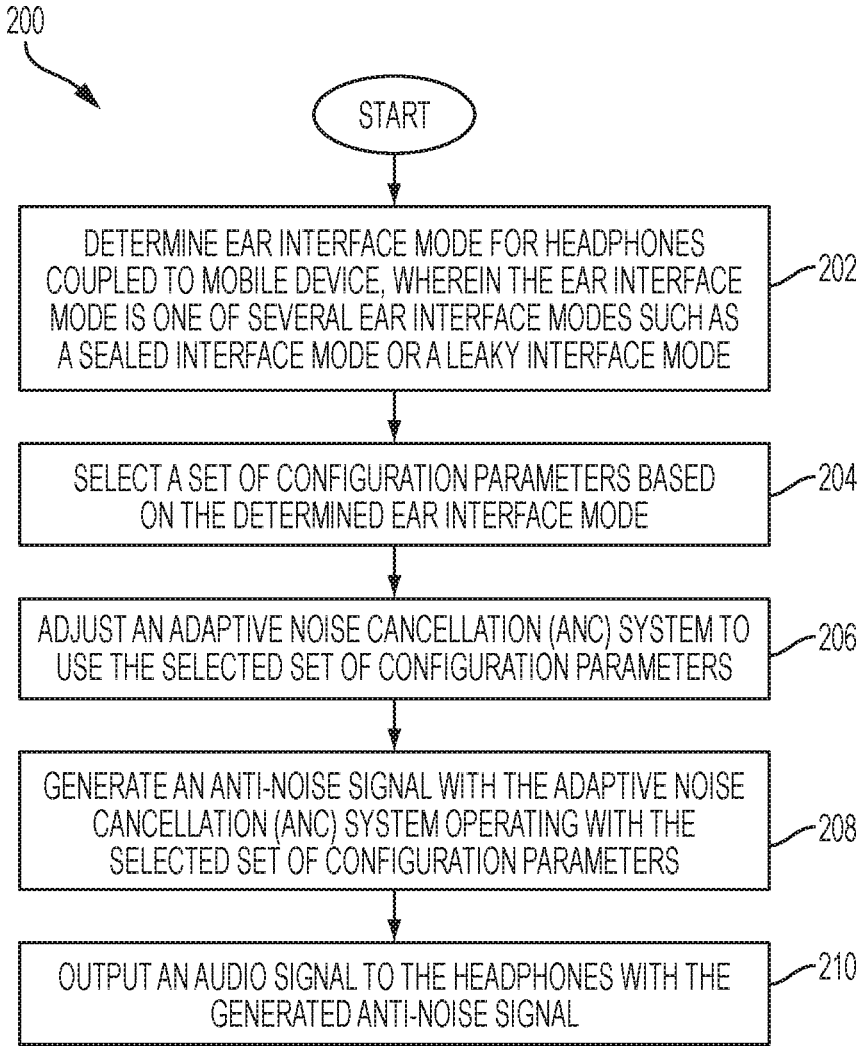
FIG. 2 is a flow chart illustrating a method of controlling an adaptive noise cancellation (ANC) system based on ear interface mode of a headphone device according to embodiments of the disclosure.

One method that may be implemented by the processor 124 of the mobile device 102, or any logic circuitry in any electronic device, for identifying an ear interface mode for a headphone and configuring the device for the ear interface mode is described with reference to FIG. 2. FIG. 2 is a flow chart illustrating a method of controlling an adaptive noise cancellation (ANC) system based on ear interface mode of a headphone device according to embodiments of the disclosure. A method 200 may begin at block 202 with determining an ear interface mode for headphones coupled to a mobile device. The determined ear interface mode may correspond to a sealed interface mode or a leaky interface mode. Then, at block 204, a set of configuration parameters is selected for an audio system based on the determined ear interface mode. For example, a memory of the mobile device may store a set of configuration parameters associated with each of the possible ear interface mode. At block 206, an ANC system may be adjusted to use the selected set of configuration parameters. At block 208, the ANC system operates to generate an anti-noise signal using the selected set of configuration parameters. At block 210, an audio signal may be output to the headphones from the mobile device using the generated anti-noise signal. The method 200 is one example operation, but variations in the steps and ordering of the steps may be used to carry out the described invention in other embodiments. For example, the steps may be performed on electronic devices other than mobile devices. Furthermore, the ear interface modes may include other conditions that sealed or leaky, such as varying degrees of leakiness. Still further, the adjustment of the audio system based on different ear interface modes may be performed through steps other than selecting a set of configuration parameters or generating an anti-noise signal based on those parameters. For example, the configuration parameters may be selected by computing some or all of the parameters values, rather than retrieving such values from memory.

Figure 3A:
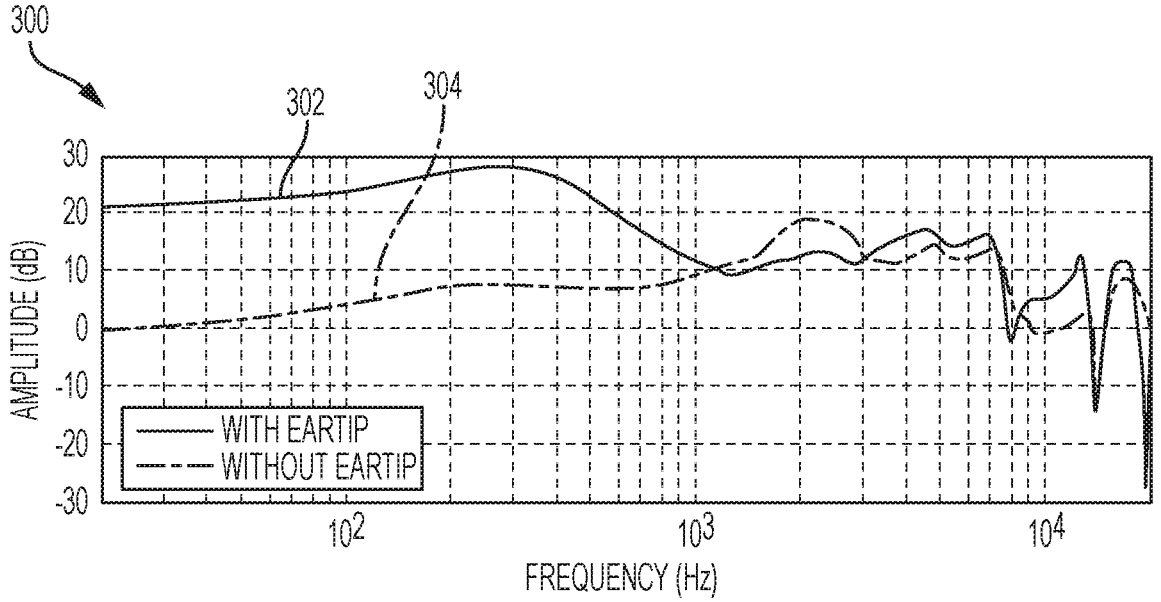
FIGS. 3A-B are graphs of acoustic responses of left and right earbuds with and without a sealing eartip according to embodiments of the disclosure.
Figure 3B:
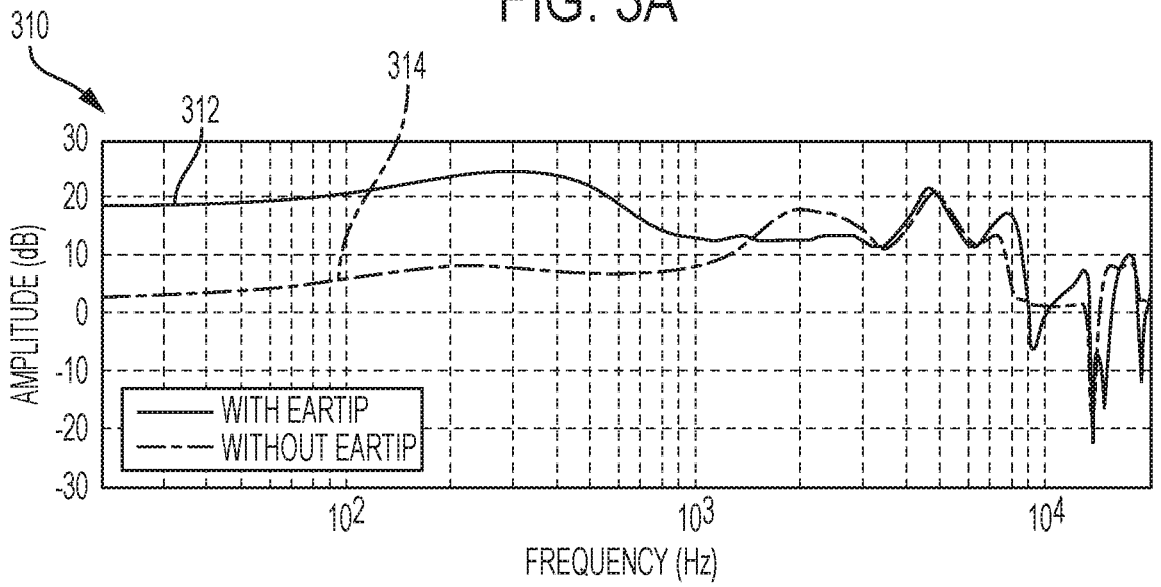
Figure 3D:
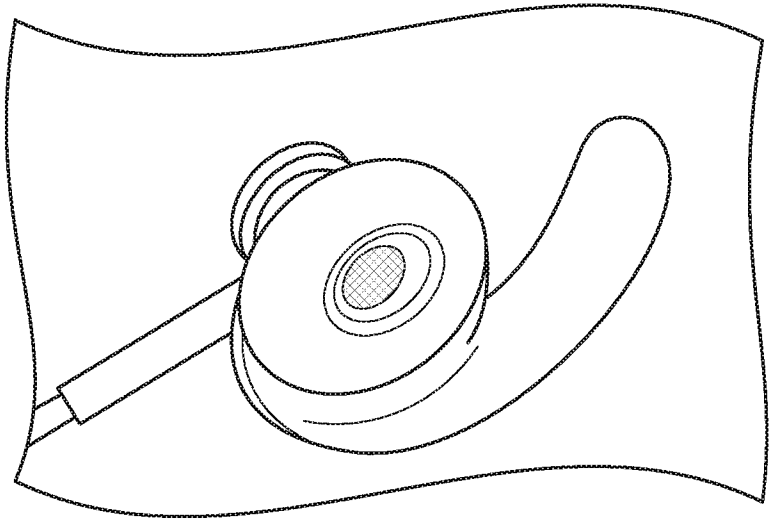
FIGS. 3C-D are illustrations of earbuds with and without a tip corresponding to examples of leaky and sealed ear interface modes according to embodiments of the disclosure.
Figure 3C:
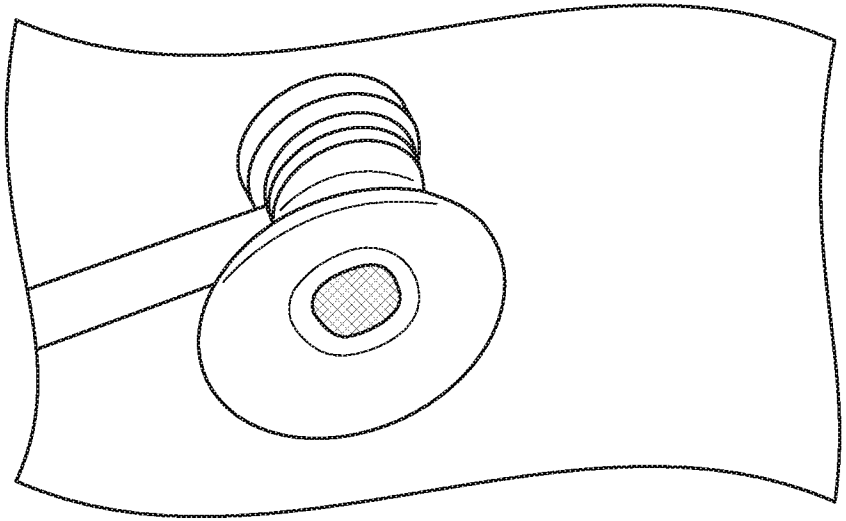

A determination of ear interface mode may be made by analyzing an acoustic response of the transducer in the headphones. A measurement of the acoustic response may be made by outputting an audio signal to the transducer and measuring audio with a microphone near the transducer. The transducer and microphone may be coupled through acoustic volume in the ear canal, and characteristics of the acoustic volume may change based on the ear interface mode of the headphones. A measurement of a secondary path acoustic volume may provide the characteristics of the acoustic volume that may be used to determine the ear interface mode. The output audio signal for the measurement may be audible or inaudible. In some embodiments, the output audio signal may be piggybacked onto a start-up signal output to the transducer when the mobile phone initializes or begins playback of audio. The measurement may be compared to a known acoustic volume signature to determine an ear interface mode that the headphone is most likely to be configured in. For example, the measurement may be compared to several known acoustic volume signatures and an integral of the difference between the signature and each measurement computed, wherein the signature with the lowest integral is determined to be the ear interface mode. Some known acoustic volume signatures are shown in FIGS. 3A-B. FIGS. 3A-B are graphs of acoustic responses of left and right earbuds with and without a sealing eartip according to embodiments of the disclosure. A graph 300 illustrates acoustic responses for a left ear transducer with an eartip in line 302 and without an eartip in line 304. A graph 310 illustrates acoustic responses for a right ear transducer with an eartip in line 312 and without an eartip in line 314. An example of an ear transducer without an eartip, which may result in a leaky configuration, is shown in FIG. 3C. An example of an ear transducer with an eartip, which may result in a sealed configuration, is shown in FIG. 3D.

Figure 4:
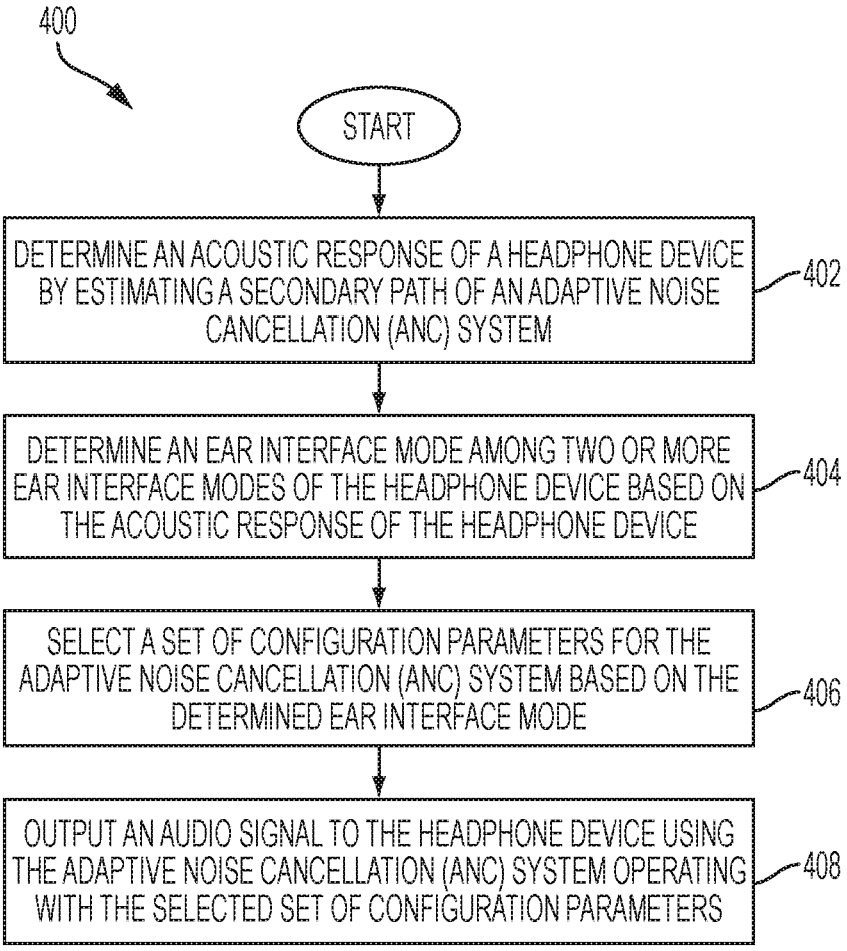
FIG. 4 is a flow chart illustrating a method of controlling an adaptive noise cancellation (ANC) system based on an ear interface mode determined with an acoustic response of a headphone device according to embodiments of the disclosure.

A method for controlling an audio system based on ear interface mode by estimating a secondary path is described with reference to FIG. 4. FIG. 4 is a flow chart illustrating a method of controlling an adaptive noise cancellation (ANC) system based on an ear interface mode determined with an acoustic response of a headphone device according to embodiments of the disclosure. A method 400 may begin at block 402 with determining an acoustic response of a headphone device by estimating, such as by processing a microphone measurement, a secondary path of an adaptive noise cancellation (ANC) system. Then, at block 404, an ear interface mode is determined for the headphone device, which may be selected from among several possible ear interface modes. At block 406, a set of configuration parameters may be selected for the ANC system based on the ear interface mode determined at block 402. Then, at block 408, an audio signal is output to the headphone device using the ANC system configured with the selected set of configuration parameters.

Figure 5:
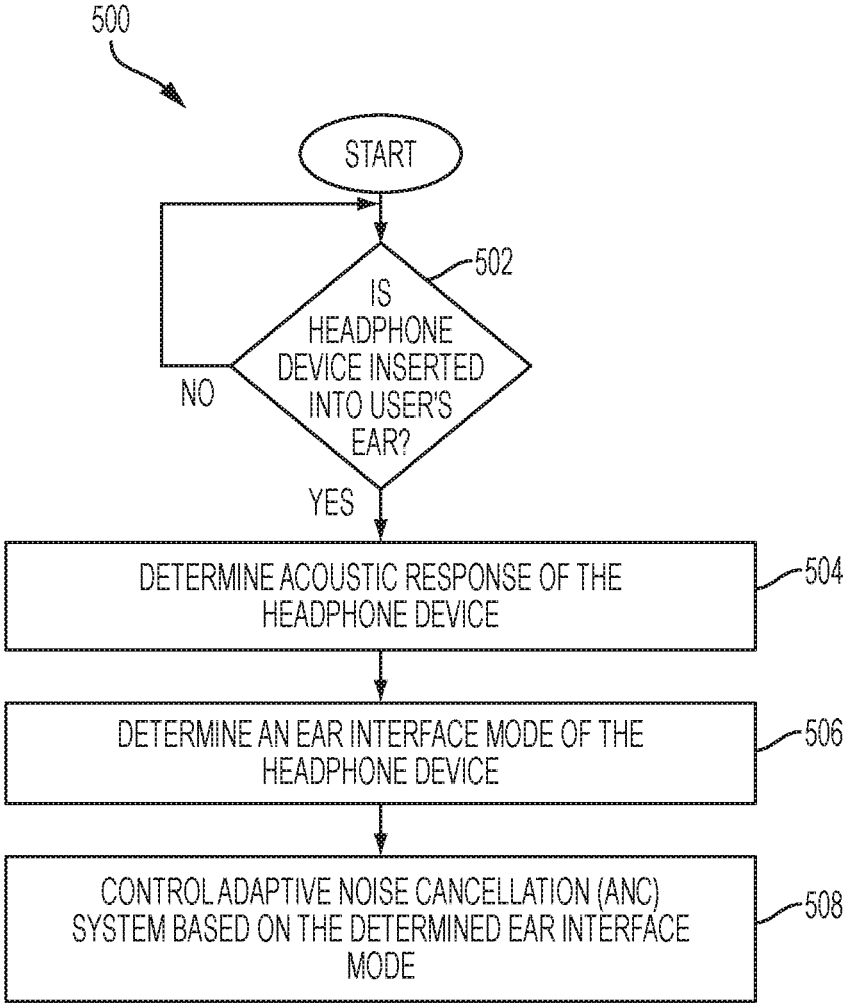
FIG. 5 is a flow chart illustrating a method of determining an ear interface mode of a headphone device after earbuds of the headphone device are inserted in a user's ear according to embodiments of the disclosure.

The determination of the ear interface mode may be hindered when the headphone device is not inserted in or on the user's ear. That is, the acoustic volume of the user's ear canal may not be measured until the headphone device is in or on the user's ear. Thus, the determination of ear interface mode and configuration of the audio system thereof may be not performed until after insertion in the user's ear is detected. A method for operating the audio system to wait for insertion into the user's ear is described with reference to FIG. 5. FIG. 5 is a flow chart illustrating a method of determining an ear interface mode of a headphone device after earbuds of the headphone device are inserted in a user's ear according to embodiments of the disclosure. A method 500 may begin at block 502 with determining if the headphone device is inserted into or on the user's ear. If not, the method 500 may loop and remain at block 502 waiting for the headphone device to be inserted in the user's ear. The determination at block 502 may be made, for example, by an optical sensor, IR sensor, or other proximity sensor located in, on, or near the headphone earbud. Additionally or alternatively, the determination at block 502 may include monitoring the secondary path transfer function and determining when a threshold condition has occurred or when an abrupt change is detected. When inserted in the ear, the method 500 continues to block 504 to determine an acoustic response of the headphone device, to block 506 to determine an ear interface mode of the headphone device, and to block 508 to control an ANC system based on the determined ear interface mode. Blocks 504, 506, and 508 may be performed similar to the methods described with reference to FIG. 2 and FIG. 4.

Figure 6:
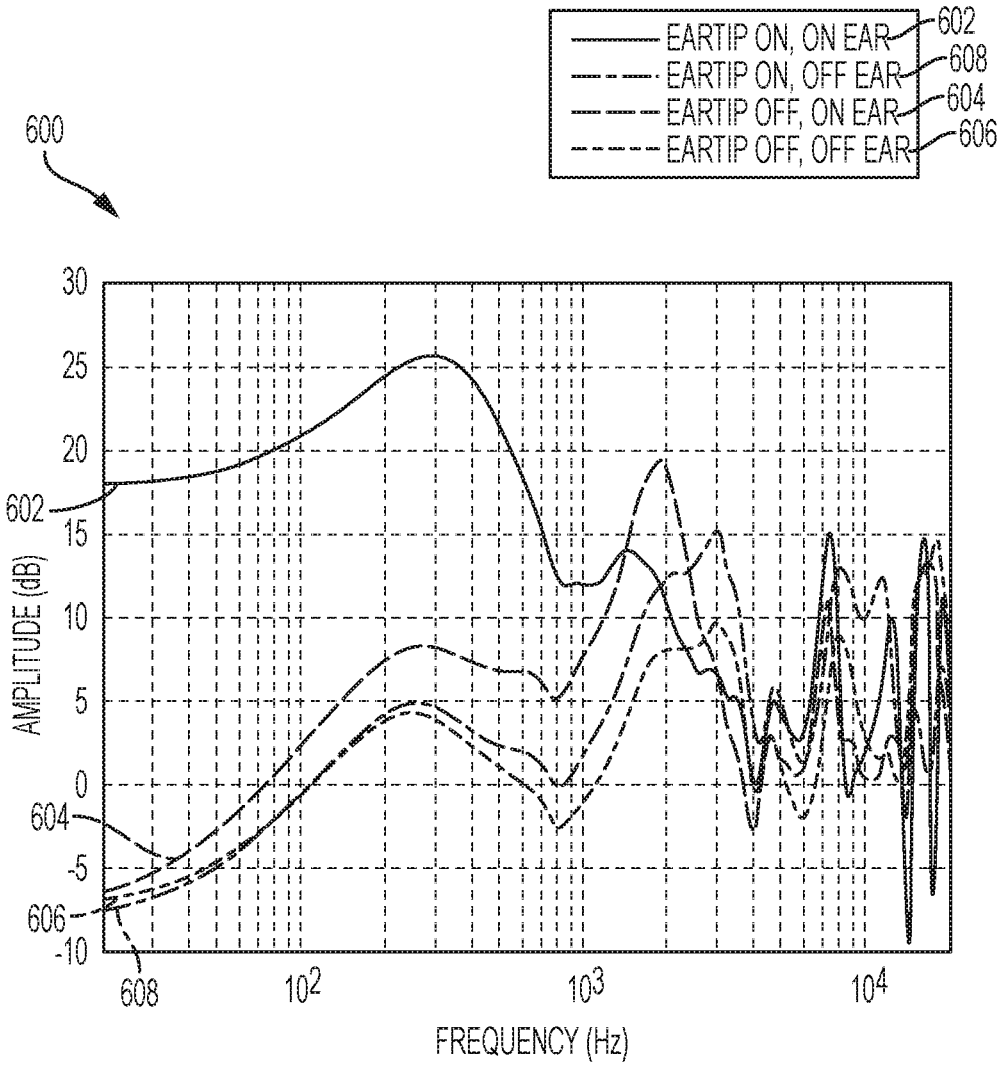
FIG. 6 are graphs of acoustic responses of headphone devices with and without a sealing ear tip and before and after insertion in a user's ear according to embodiments of the disclosure.

The determination of whether the headphone device is in an "on ear" state, such as when the headphone device is in or on the user's ear, or in an "off ear" state may affect the measured acoustic response of the headphone device. A comparison of the acoustic response in an "on ear" and "off ear" condition is shown in FIG. 6. FIG. 6 are graphs of acoustic responses of headphone devices with and without a sealing ear tip and before and after insertion in a user's ear according to embodiments of the disclosure. A graph 600 illustrates acoustic responses for various configurations in lines 602, 604, 606, and 608. Line 602 shows an acoustic response for a headphone device with eartip and in an "on ear" state, whereas line 608 shows an acoustic response for a headphone device with eartip and in an "off ear" state. Line 604 shows an acoustic response for a headphone device without eartip and in an "on ear" state, whereas line 606 shows an acoustic response for a headphone device without eartip and in an "off ear" state. Because the acoustic responses between "on ear" and "off ear" states are different, as shown between lines 602 and 608 and between lines 604 and 606, some embodiments may implement block 502 of FIG. 5 to wait to perform an acoustic response measurement until the headphone device is in an "on ear" state. However, when no wait is implemented, the ear interface mode may be detected, for example, when known acoustic response signatures are available for the headphone device in an "off ear" state.

Figure 7:
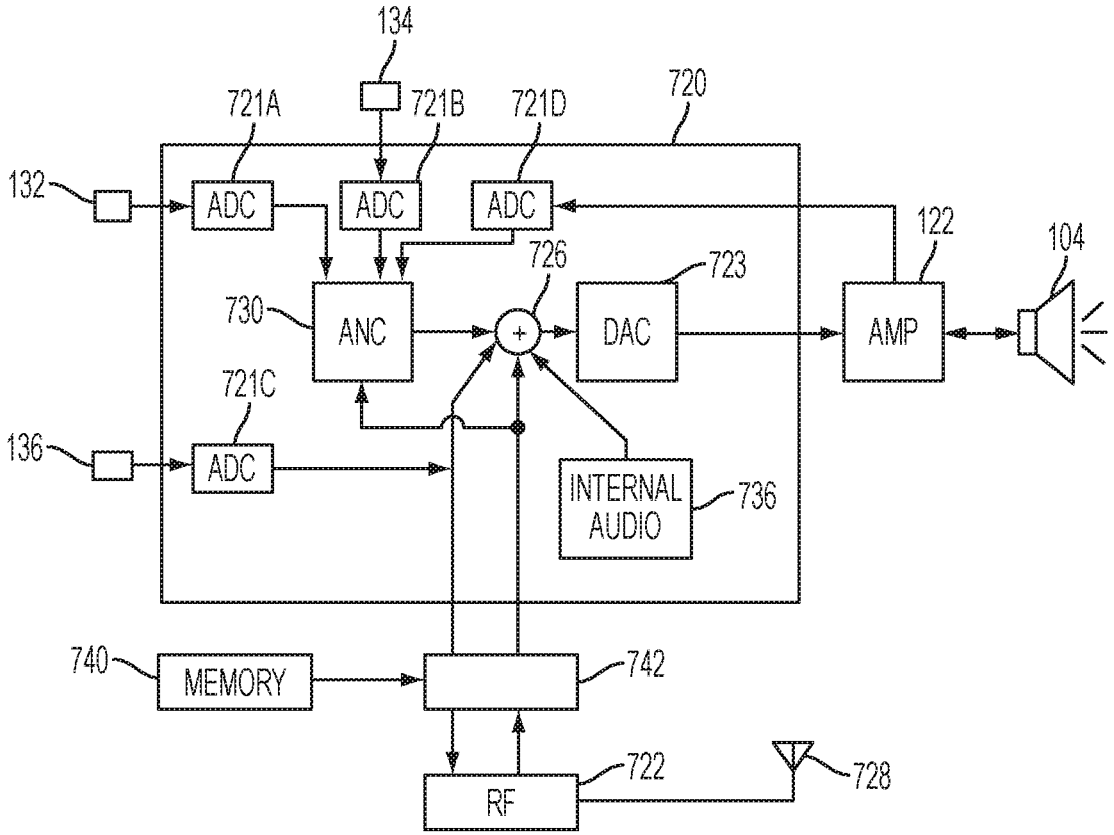
FIG. 7 is a block diagram illustrating a noise canceling system according to one embodiment of the disclosure.

A determined ear interface mode may be provided to an adaptive noise cancellation (ANC) system for adapting the noise control system. FIG. 7 is a block diagram illustrating a noise canceling system according to embodiments of the disclosure. A circuit 720 may receive input from the microphones 132, 134, and 136. Analog values from the microphones 132, 134, and 136 may be converted by analog-to-digital converters (ADCs) 721A, 721B, and 721C. The ADCs 721A, 721B, and 721C may be part of the noise control system or may be built into the microphones 132, 134, and 136, respectively. In one embodiment, the microphones 132, 134, and 136 are digital microphones, and no ADCs are placed between the digital microphones and the circuit 720. The circuit 720 may also receive input from the speaker 104, such as an impedance value of the speaker 104. The impedance value may be calculated by the amplifier 122 and output to an analog-to-digital converter 721D, which converts the impedance value to a digital value for ANC circuit 730. In one embodiment, the speaker impedance output by the amplifier 122 is a digital value, and no analog-to-digital converter is present. The ANC circuit 730 may use information from the microphones 132, 134, and 136 to estimate a secondary path of the ANC system. For example, the ANC circuit 730 may compute a S(z) transfer function referred to as a secondary path, which represents the effect of filters, ADCs, DACs, speaker, microphone(s), and acoustic path between a canceling speaker and microphone(s).

The ANC circuit 730 may generate an anti-noise signal, which is provided to a combiner 726. The anti-noise signal may be generated based on a selected set of configuration parameters. The configuration parameters may be selected based on a determination of an ear interface mode for the headphone device containing the transducer 104. In some embodiments, the configuration parameters may be written into memory, such as registers, within the ANC circuit 730, after determination of the ear interface. The writing of the configuration parameters to the memory may be performed under control of an application processor coupled to the circuit 720, such as a central processing unit (CPU) located within the mobile device containing the circuit 720. Such an application processor may be executing a mobile application that performs testing of the acoustic response of the headphone device or that receives user input regarding the ear interface mode. The combiner 726 combines the anti-noise signal from the ANC circuit 730 with sound from the near speech microphone 136, internal audio 726, and audio signals. The audio signals may be received wirelessly through an antenna 728 and processed by a radio frequency (RF) circuit 722, such as when the audio signals are a wireless telephone call or audio streamed from over a network connection. The audio signals may also or alternatively be received from a local memory 740, such as when the audio signals are locally-stored music or ringtones. A multiplexer 742 may be present to select an audio signal for input to the combiner 726. The internal audio 736 may be, for example, ringtones, audio files, and/or audio portions of video files. Audio signals received through the antenna 728 may be, for example, streamed analog or digital audio signals and/or telephone conversations. The combiner 726 provides a single signal to a digital-to-analog converter (DAC) 723. The DAC 723 converts the digital signal of the combiner 723 to an analog audio signal for amplification by the amplifier 122 and output at the speaker 104.

During some operation of the ANC systems described above, the ANC system may operate using a temporary parameter set. The temporary parameter set may be a parameter set known to safely control the ANC output regardless of the ear interface mode of an attached headset. For example, referring back to block 502 of FIG. 5, a temporary parameter set may be selected for the ANC system while waiting for the headphone device to be inserted into the user's ear. After the acoustic response of the headphone device is determined at block 504, the temporary parameter set may be replaced with a parameter set selected based on the acoustic response of the headphone device. As another example, a temporary parameter set may be selected for the ANC system during an initial start-up of an audio controller. A method implementing a temporary parameter set during reset, such as occurs during start-up, is described with reference to FIG. 8.

Figure 8:
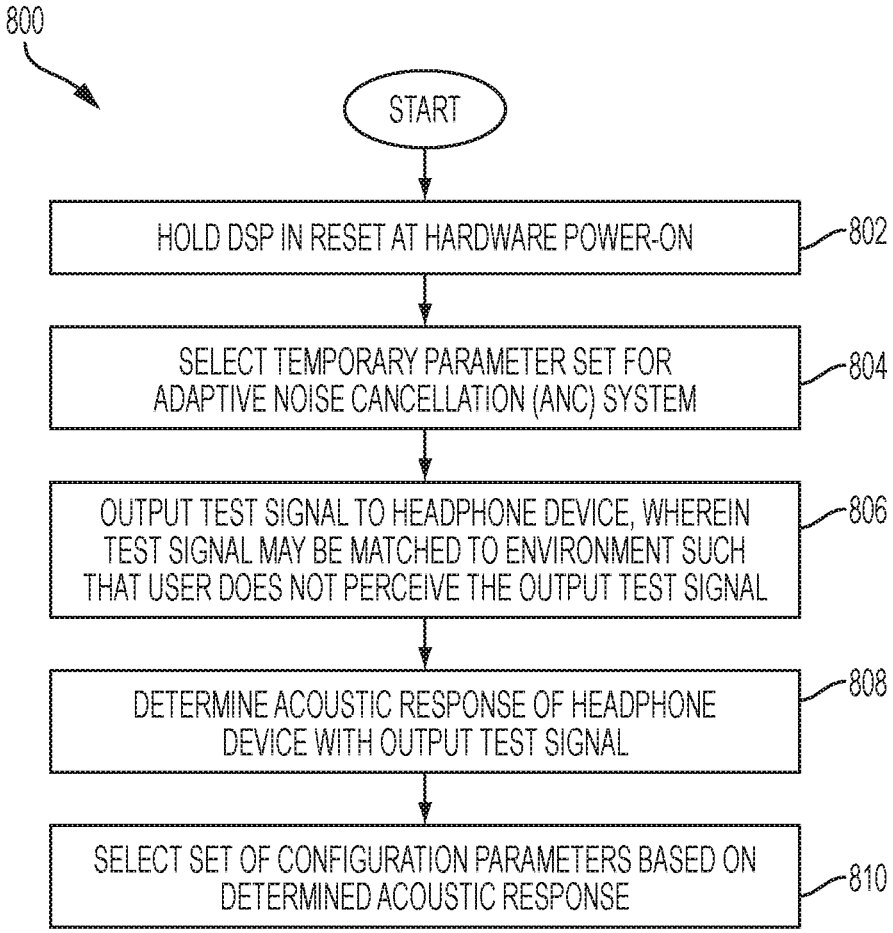
FIG. 8 is a flow chart illustrating a method of configuring an adaptive noise cancellation (ANC) system with a temporary parameter set until the ear interface mode is determined according to embodiments of the disclosure.

FIG. 8 is a flow chart illustrating a method of configuring an adaptive noise cancellation (ANC) system with a temporary parameter set until the ear interface mode is determined according to embodiments of the disclosure. A method 800 begins at block 802 with holding an audio controller, such as a digital signal processor (DSP) of an audio or video coder/decoder (CODEC) chip, in reset at hardware power-on. At block 804, a set of temporary parameters may be selected for the ANC system. The ANC system may operate using these temporary parameters to, for example, generate anti-noise signals until an ear interface mode of the headphone device is determined. At block 806, a test signal may be output to a headphone device. The test signal may be selected such that the user does not perceive the output test signal. Such a test signal may include inaudible signals or audible signals that are not easily distinguished by the user in comparison to environmental sounds (such as measured by microphones 132, 134, and 136) or in comparison to other audio sounds output to the transducer. At block 808, an acoustic response of the headphone device may be determined using the output test signal of block 806. Then, at block 810, a set of configuration parameters may be selected based on the determined acoustic response at block 808. For example, an ear interface mode of the headphone device may be determined from the acoustic response, and a set of configuration parameters associated with that ear interface mode set in the ANC system.

Example embodiments described above illustrate the determination of the presence of ear molding on headphones and modifying operation of an adaptive noise cancellation (ANC) system to match the headphones. The ear molding of the headphones may correspond to different ear interface modes. However, the presence of or configuration of ear molding is only one example physical characteristic that may produce different ear interface modes. Furthermore, embodiments of the invention may perform other functionality on different devices. For example, different characteristics of headphones may result in different ear interface configurations resulting in different acoustic responses for different headphones or different acoustic responses for a single headphone. That is, the molding on, or otherwise the shape of, the headphones is only one possible characteristic affecting ear interface mode. Other factors, such as ear tip size, configuration of the string attaching the two earbuds of the headphones, and/or presence of a clip for holding the earbud in the ear, may affect the acoustic response and used to determine an ear interface mode of the headphones. Furthermore, the transducer being used to output sounds from the ANC system may be located in any type of housing, in which headphones are only one example. For example, the transducer may be located in speakers.

The schematic flow chart diagrams of FIG. 2, FIG. 4, FIG. 5, and FIG. 8 are generally set forth as a logical flow chart diagram. As such, the depicted order and labeled steps are indicative of aspects of the disclosed method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagram, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The operations described above as performed by a controller, DSP, or ANC system may be performed by any circuit configured to perform the described operations. Such a circuit may be an integrated circuit (IC) constructed on a semiconductor substrate and include logic circuitry, such as transistors configured as logic gates, and memory circuitry, such as transistors and capacitors configured as dynamic random access memory (DRAM), electronically programmable read-only memory (EPROM), or other memory devices. The logic circuitry may be configured through hard-wire connections or through programming by instructions contained in firmware. Further, the logic circuitry may be configured as a general purpose processor capable of executing instructions contained in software. If implemented in firmware and/or software, functions described above may be stored as one or more instructions or code on a computer-readable medium. Examples include non-transitory computer-readable media encoded with a data structure and computer-readable media encoded with a computer program. Computer-readable media includes physical computer storage media. A storage medium may be any available medium that can be accessed by a computer. By way of example, and not limitation, such computer-readable media can comprise random access memory (RAM), read-only memory (ROM), electrically-erasable programmable read-only memory (EEPROM), compact disc read-only memory (CD-ROM) or other optical disk storage, magnetic disk storage or other magnetic storage devices, or any other medium that can be used to store desired program code in the form of instructions or data structures and that can be accessed by a computer. Disk and disc includes compact discs (CD), laser discs, optical discs, digital versatile discs (DVD), floppy disks and Blu-ray discs. Generally, disks reproduce data magnetically, and discs reproduce data optically. Combinations of the above should also be included within the scope of computer-readable media.

In addition to storage on computer readable medium, instructions and/or data may be provided as signals on transmission media included in a communication apparatus. For example, a communication apparatus may include a transceiver having signals indicative of instructions and data. The instructions and data are configured to cause one or more processors to implement the functions outlined in the claims.

Although the present disclosure and certain representative advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. For example, although digital signal processors (DSPs) are described throughout the detailed description, aspects of the invention may be applied to the design of other processors, such as graphics processing units (GPUs) and central processing units (CPUs). As one of ordinary skill in the art will readily appreciate from the present disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. A method, comprising:

setting a temporary set of configuration parameters for an adaptive noise cancellation (ANC) system including the headphone device;

determining if the headphone device is inserted into or on a user's ear; and when the headphone device is determined to be inserted into or on the user's ear:

determining an acoustic response of the headphone device by estimating a secondary path of the adaptive noise cancellation (ANC) system;

determining an ear interface mode among two or more ear interface modes of the headphone device based, at least in part, on the acoustic response of the headphone device including the secondary path;

selecting a set of configuration parameters for the adaptive noise cancellation (ANC) system based, at least in part, on the determined ear interface mode; and outputting an audio signal to the headphone device, wherein the audio signal includes an anti-noise signal generated by the adaptive noise cancellation (ANC) system based, at least in part, on the selected set of configuration parameters, wherein the step of determining the ear interface mode comprises determining whether the headphone device is configured with an ear tip or is configured without an ear tip.

2. The method of claim 1, wherein the step of determining the ear interface mode comprises determining whether the headphone device is in a leaky ear interface mode or is in a sealing ear interface mode.

3. The method of claim 1, wherein the step of selecting the set of configuration parameters comprises selecting a set of adaptive noise cancellation (ANC) parameters for playback of media through the headphone device, and wherein the audio signal includes playback of the media adjusted according to the set of adaptive noise cancellation (ANC) parameters.

4. The method of claim 1, wherein the step of determining the acoustic response of the headphone device comprises outputting an inaudible signal to the headphone device to calculate an acoustic volume of the secondary path.

5. The method of claim 1, further comprising:

determining the headphone device is inserted in a user's ear, wherein the step of determining the acoustic response of the headphone device is performed after the step of determining the headphone device is inserted in the user's ear.

6. The method of claim 1, wherein the step of determining the ear interface mode among two or more ear interface modes comprises comparing the acoustic response with a look-up table of known acoustic responses and corresponding ear interface modes.

7. An apparatus, comprising:

a memory; and a processor coupled to the memory, wherein the processor is configured to perform steps comprising:

setting a temporary set of configuration parameters for an adaptive noise cancellation (ANC) system including the headphone device;

determining if the headphone device is inserted into or on a user's ear; and when the headphone device is determined to be inserted into or on the user's ear:

determining an acoustic response of a headphone device by estimating a secondary path of an adaptive noise cancellation (ANC) system including the headphone device;

determining an ear interface mode among two or more ear interface modes of the headphone device based, at least in part, on the acoustic response of the headphone of device including the secondary path;

selecting a set of configuration parameters for the adaptive noise cancellation (ANC) system based, at least in part, on the determined ear interface mode; and outputting an audio signal to the headphone device, wherein the audio signal includes an anti-noise signal generated by the adaptive noise cancellation (ANC) system based, at least in part, on the selected set of configuration parameters, wherein the step of determining the ear interface mode comprises determining whether the headphone device is configured with an eartip or is configured without an ear tip.

8. The apparatus of claim 7, wherein the step of determining the ear interface mode comprises determining whether the headphone device is in a leaky ear interface mode or is in a sealing ear interface mode.

9. The apparatus of claim 7, wherein the step of selecting the set of configuration parameters comprises selecting a set of adaptive noise cancellation (ANC) parameters for playback of media through the headphone device, and wherein the audio signal includes playback of the media adjusted according to the set of adaptive noise cancellation (ANC) parameters.

10. The apparatus of claim 7, wherein the step of determining the acoustic response of the headphone device comprises outputting an inaudible signal to the headphone device to calculate an acoustic volume of the secondary path.

11. The apparatus of claim 7, wherein the processor is further configured to perform steps comprising:

determining the headphone device is inserted in a user's ear, wherein the step of determining the acoustic response of the headphone device is performed after the step of determining the headphone device is inserted in the user's ear.

12. The apparatus of claim 7, wherein the step of determining the ear interface mode among two or more ear interface modes comprises comparing the acoustic response with a look-up table of known acoustic responses and corresponding ear interface modes.

13. A computer program product, comprising:

a non-transitory computer readable medium comprising code to perform steps comprising:

setting a temporary set of configuration parameters for an adaptive noise cancellation (ANC) system including the headphone device;

determining if the headphone device is inserted into or on a user's ear;

when the headphone device is determined to be inserted into or on the user's ear:

determining an acoustic response of a headphone device by estimating a secondary path of an adaptive noise cancellation (ANC) system including the headphone device;

determining an ear interface mode among two or more ear interface modes of the headphone device based, at least in part, on the acoustic response of the headphone of device including the secondary path;

selecting a set of configuration parameters for the adaptive noise cancellation (ANC) system based, at least in part, on the determined ear interface mode; and outputting an audio signal to the headphone device, wherein the audio signal includes an anti-noise signal generated by the adaptive noise cancellation (ANC) system based, at least in part, on the selected set of configuration parameters, wherein the step of determining the ear interface mode comprises determining whether the headphone device is configured with an ear tip or is configured without an ear tip.

14. The computer program product of claim 13, wherein the step of determining the ear interface mode comprises determining whether the headphone device is in a leaky ear interface mode or is in a sealing ear interface mode.

15. The computer program product of claim 13, wherein the medium further comprises code to perform the steps comprising:

determining the headphone device is inserted in a user's ear, wherein the step of determining the acoustic response of the headphone device is performed after the step of determining the headphone device is inserted in the user's ear.

16. The computer program product of claim 13, wherein the step of determining the ear interface mode among two or more ear interface modes comprises comparing the acoustic response with a look-up table of known acoustic responses and corresponding ear interface modes.

17. The computer program product of claim 13, wherein the step of selecting the set of configuration parameters comprises selecting a set of adaptive noise cancellation (ANC) parameters for playback of media through the headphone device, and wherein the audio signal includes playback of the media adjusted according to the set of adaptive noise cancellation (ANC) parameters.

* * * * *